US006803244B2

(12) United States Patent
Diener et al.

(10) Patent No.: US 6,803,244 B2
(45) Date of Patent: Oct. 12, 2004

(54) NANOSTRUCTURED REACTIVE SUBSTANCE AND PROCESS FOR PRODUCING THE SAME

(75) Inventors: Joachim Diener, Ergoldsbach (DE); Egon Gross, Taufkirchen (DE); Nicolai Künzer, München (DE); Manfred Schildknecht, Eckental-Eckenhaid (DE); Karl Rudolf, Schrobenhausen (DE); Heinz Hofmann, Schnittach (DE); Dimitri Kovalev, Garching (DE); Victor Timosnenko, Moscow (RU)

(73) Assignee: Diehl Munitionssysteme GmbH & Co. KG, Roethenback (DE)

( * ) Notice: Subject to any disclaimer, the term of this patent is extended or adjusted under 35 U.S.C. 154(b) by 0 days.

(21) Appl. No.: 10/360,429

(22) Filed: Feb. 6, 2003

(65) Prior Publication Data

US 2003/0148569 A1 Aug. 7, 2003

(30) Foreign Application Priority Data

Feb. 6, 2002 (DE) ..... 102 04 895

(51) Int. Cl.[7] ..... H01L 21/00
(52) U.S. Cl. ..... 438/22
(58) Field of Search ..... 438/22

(56) References Cited

U.S. PATENT DOCUMENTS 6,203,864 B1 * 3/2001 Zhang et al. ..... 427/592
6,482,517 B1 * 11/2002 Anderson ..... 428/402.24
2002/0168466 A1 * 11/2002 Tapphorn et al. ..... 427/180

OTHER PUBLICATIONS

Mikulec, F. V. et al.: "Explosive Nanocrystalline Porous Silicon and Its Use in Atomic Emission Spectroscopy", Wiley–VCH Verlag GmbH, Adv. Mater. 2002, 14, No. 1, Jan. 4, 2002, pp. 38–41.

Kovalev, D. et al.: "Strong Explosive Interaction of Hydrogenated Porous Silicon with Oxygen at Cryogenic Temperatures", The American Physical Society, Physical Review Letters, vol. 87, No. 6, Aug. 6, 2001, pp. 068301–1 to 068301–4.

* cited by examiner

*Primary Examiner*—David Nelms
*Assistant Examiner*—Thao P. Le

(57) ABSTRACT

In a nanostructured reactive substance and a process for producing the same, intermixing of silicon and oxidizing agent on a nanometer size scale permits virtually direct contact between the fuel and the oxidizing agent, only separated by a barrier layer. After the barrier layer is broken open, fuel and oxidizing agent are spatially directly together and can react, liberating energy. The reactive substance has a high reaction rate in comparison with conventional reactive materials.

18 Claims, No Drawings

NANOSTRUCTURED REACTIVE SUBSTANCE AND PROCESS FOR PRODUCING THE SAME

BACKGROUND OF THE INVENTION

FIELD OF THE INVENTION

The invention relates to nanostructured reactive substances formed as reactive bodies. The invention also relates to a process for producing reactive substances.

A publication entitled "Strong Explosive Interaction of Hydrogenated Porous Silicon with Oxygen at Cryogenic Temperatures" in Physical Review Letters 8 (2001), 068301 (Jul. 19, 2001), describes how porous silicon samples including silicon structures in a range of sizes of several nanometers with hydrogen-covered surfaces react explosively if they are dipped into liquid oxygen or if oxygen condenses out of the ambient atmosphere in the pores of the silicon samples at low temperatures. The reaction occurs in a temperature range of between 4.2 K and about 90 K. The hydrogen atoms on the surface of the silicon structures in that case play the part of a buffer or barrier layer which prevents direct contact of the fuel silicon with the oxidizing agent liquid oxygen. As soon as that buffer layer is broken open by the action of energy, impact, or laser pulse, silicon atoms are exposed at the surface of the silicon structures and can react with the oxygen in the pores. The energy of the oxidation reaction, which is liberated in that situation causes, inter alia, the further removal of hydrogen from the surface of the silicon structures and thus exposure of silicon atoms which in turn then react with the oxygen in the ambient atmosphere.

Partial oxidation of the surface of the silicon structures results in stabilization of the system. However, since liquid oxygen has to be introduced for the reaction, the reaction only takes place at cryogenic temperatures to ~90 K. Triggering of the reaction takes place spontaneously. The reactive system is therefore not stable and cannot be handled in practice.

A publication entitled "Explosive Nanocrystalline Porous Silicon and Its Use in Atomic Emission Spectroscopy" in Advanced Materials 2002, 14, No 1 (Jan. 4, 2002), describes how porous silicon with a typical structure or pore size of up to 1 micrometer is filled with a solution of gadolinium nitrate ($Gd(NO_3)_3*6H_2O$ in ethanol. The samples are thereafter dried. Those reactive filled samples explode upon being scratched with a diamond cutter or upon being ignited with an electric spark. The high temperatures which occur in the explosion make it possible to operate spectroscopy at the respective metals contained in the nitrate salt, Li, Na, K, Rb and Cs. Samples which contain a great deal of surface oxide, and were therefore oxidized or tempered, do not react. Therefore, that experiment exclusively uses freshly produced samples with a hydrogen covering. There is no mention of the fact that the oxidized samples are stable or that the oxide forms a buffer layer. Reference is also made to the aboveindicated publication and it is asserted that, in contrast to filling with liquid oxygen or other liquid oxidizing agents, the samples can be caused to explode in a more controlled manner if they have a filling of nitrate salt as the reactive solid. In that case, however, the activation energy for triggering the explosive reaction is still too low to ensure practicable use as a reliable pyrotechnic substance.

SUMMARY OF THE INVENTION

It is accordingly an object of the invention to provide a nanostructured reactive substance and a process for producing the same, which overcome the hereinafore-mentioned disadvantages of the heretofore-known substances and processes of this general type, in which the nanostructured reactive substance can be safely handled and in which fuel and oxidizing agent on a nanometer size scale are present in a stable condition of being spatially separated from each other and can be caused to react explosively with each other through the action of energy.

With the foregoing and other objects in view, there is provided, in accordance with the invention, a nanostructured porous reactive substance formed as a reactive body, comprising mutually independent reactive particles defining cavities therebetween. The cavities have a range of sizes of 1–1000 nm. Barrier layers encase the particles and an oxidizing agent is disposed in the cavities.

With the objects of the invention in view, there is also provided a nanostructured porous reactive substance formed as a reactive body, comprising a completely oxidized surface having cavities. An oxidizing agent is disposed in the cavities.

With the objects of the invention in view, there is additionally provided a process for producing a reactive substance, which comprises applying the reactive barrier layers for preventing premature oxidation. The barrier layers are applied by a chemical, electrochemical, physical or vapor deposition process.

With the objects of the invention in view, there is furthermore provided a process for producing a reactive substance, which comprises introducing the oxidizing agent into the cavities multiple times. This is done to vary a degree of filling with the oxidizing agent.

With the objects of the invention in view, there is concomitantly provided a process for producing a reactive substance, which comprises forming a reactive fuel-oxidizing agent system from the particles or the surface and the oxidizing agent. Metal contacts are applied to the reactive fuel-oxidizing agent system.

Intermixing of fuel (silicon) and oxidizing agent on a nanometer size scale permits virtually direct contact between the fuel and the oxidizing agent, only separated by a protective of barrier layer. After the barrier layer is broken open the fuel and the oxidizing agent are spatially directly together and can react, with the liberation of energy.

The silicon-oxygen bond is, for example, about 18 KJ/mol stronger than the carbon-oxygen bond, thereby explaining the increased energy density.

The virtually independent adjustability of porosity and mean size of the silicon structures or pores means that it is possible to adjust the amount of the educts involved in the reaction in such a way that the progress thereof can be influenced. Thus, depending on the respective ratio of fuel (silicon) and oxidizing agent, reaction types of burning away, explosion and detonation are possible. In order to achieve a given reaction type, the parameters with respect to porosity and mean pore or silicon structure size are to be matched to the oxidizing agent in such a way that optimum quantitative ratios which follow from stoichiometry apply.

The reactive substance according to the invention can be safely handled in the temperature range of between −40° C. and +100° C. and even in situations involving unwanted external effects such as impact, being dropped, light, heat, electromagnetic fields, scratching or sawing in silicon process lines.

The reactive substance can be integrated on chips or other devices and is suitable for fuses or igniters for pulse-producing, gas-producing, light-producing, flame-producing and shock wave-producing media.

In particular, the invention is suitable as a pulse element for projectiles, for the positional regulation of satellites and control of rockets, flying objects, missiles and projectiles and for firing explosives and igniting other charges such as propellant charges and pyrotechnic charges.

In addition, the reactive substance is suitable as a chip-integrated ultra-fast heating element for mass-spectroscopic use or for the destruction of EPROMs.

Small amounts of the reactive substance are sufficient by virtue of the high energy density, so that it can be readily miniaturized.

The reactive substance has a high energy density and energy liberation rate in comparison with conventional reactive materials. The energy liberation rate can be freely selected in a simple manner by the choice of a suitable geometrical structure and/or structure size. It can be set to range from burning to detonation. If the reactive substance is used as an explosive, the energy density is around up to a factor of 5 greater than in the case of TNT.

The parameters which are characteristic of an explosion are, for example:

1) high temperature (12,000 K)

2) fast reaction progress>104 m/s 3) high energy density (28 kJ/g).

A possible form of implementation is based on porous silicon. Porous silicon is produced by electrochemical etching of crystalline silicon (for example silicon discs, wafers) and represents a spongy structure including a silicon lattice and pores or cavities (holes). The mean size of the pores and the silicon structures remaining after the etching operation and porosity (defined as the proportion by volume of the pores to the total volume of the porous silicon sample) can be adjusted by suitable selection of the parameters of the starting material being used (substrate doping, etching current density, concentration or composition of the etching solution).

It is possible to achieve mean sizes with respect to pores and silicon structures in the range of between about 1 nm and 1000 nm. Porosity can be adjusted approximately over a range of 10%–98%.

Since the pore network of the porous silicon samples is accessible from the exterior (the ambient atmosphere), oxidizing agents can be introduced into the pores. The specified substances listed hereinbelow appear suitable.

After production (electrochemical etching) of the porous silicon samples, the surface of the remaining silicon structures is covered with a monolayer of atomic hydrogen. If an oxidizing agent is now in the pores of the porous silicon sample, it is sufficient to break open a silicon-hydrogen bond at the surface of the silicon structures by the action of energy and thus to achieve contact of the silicon, which is now exposed, with the oxidizing agent. In that situation, the silicon oxidizes with the liberation of energy. That results in the breakage of further bonds of the passivated surface of the silicon lattice and that consequently results in a chain reaction in which further silicon is oxidized.

The silicon-hydrogen bond at the surface of the nanostructured lattice is relatively weak and thus the mixture of fuel (silicon) and oxidizing agent which is present on the nanometer size scale in the pores is relatively unstable. It is necessary to effect additional passivation of the surface of the silicon lattice in order to increase stability. That can be effected, for example, by an oxidation operation (heat treatment of the samples in an oxygen atmosphere) with respect to the porous silicon sample after manufacture. A barrier or buffer layer is formed (sub-oxide layer including a sub-monolayer of oxygen). The strength of the passivation effect can be adjusted according to the respective duration of the heat treatment (completeness of the oxidation of the surface). Attention is directed to the specific embodiment for details in that respect. The barrier or protective layer increases the stability of the samples which are put into the reactive condition (filling of the pores with oxidizing agent). The barrier layer which is produced can also function as a diffusion barrier for oxidation processes that take place slowly and which can result in degradation of the reactive mixture. It is to be noted in the given example of use that the hydrogen-covered surface of the silicon structures in porous silicon in air is not stable in relation to oxidation. A sub-monolayer of silicon oxide is formed at the surface of the silicon structures in a period of approximately a year. In the case of a reactive mixture of non-tempered porous silicon and oxidizing agent, this means that the properties of the explosive reaction and the firing mechanism (firing threshold) vary over the course of time.

Firing of the reactive samples is effected by a supply of energy and breaks open the barrier layer, thereby providing for direct contact of the fuel (silicon) with the oxidizing agent. Possible firing mechanisms are impact, an increase in temperature (for example by a flow of current or a laser pulse), and pulsed laser radiation (which is, for example, in resonance with a silicon-hydrogen or silicon-oxygen surface bond).

It is possible to produce small, nanometer-size silicon particles (colloids) and to form a powder therefrom. The reaction takes place, for example, by way of the slow combustion of silane. In contrast to the above-described process in which pores are etched into a solid body (silicon), the aim now is to enclose the silicon particles with a layer of oxidizing agent and then compact them to form a solid body. In that case the spacing of the particles in the material is adjusted by the thickness of the barrier or protective layer applied to or encasing the silicon particles. Another process provides for interconnecting the individual silicon nanocrystals by surface atoms of the silicon particles. The functional groups of "spacer" molecules function as spacers and also as a provider for an oxidant. An advantage of this implementation is that, in contrast to the porous silicon, there are no "connecting arms" between the nanometer-size silicon structures (solid body lattice), which can easily break under the effect of an impact, can form free silicon bonds and can thus result in an unintended reaction. The compactable body, in contrast to porous silicon, can also be geometrically freely shaped.

Other features which are considered as characteristic for the invention are set forth in the appended claims.

Although the invention is described herein as embodied in a nanostructured reactive substance and a process for producing the same, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying example.

DESCRIPTION OF THE PREFERRED EMBODIMENTS

Reference is now made to a specific embodiment example, in which porous silicon with $LiNO_3$ is provided as an oxidizing agent in the pores or cavities:

Porous silicon is produced by electrochemical etching of a silicon wafer (surface (100), specific conductivity 8 ohmcentimeter) with an etching solution of hydrofluoric acid (HF 49 percent by weight in water) and ethanol (proportion by volume 1:1). The etching current density is 50 mA/cm$^2$. The etching time is 30 minutes.

After the etching process, the sample is tempered at 200° C. in air for 1600 minutes, in which case the surface of the silicon structures is passivated with a sub-monolayer (one atom layer under the surface of the silicon structures) of oxygen. However, the surface of the silicon structures remains covered with hydrogen. A further possible option lies in tempering at 700° C. for 30 seconds. In that case, the hydrogen at the surface of the silicon structures is also removed. The stability of the reactive samples filled with oxidizing agent can be slightly or greatly increased in relation to the samples without tempering, depending on the nature of the respective tempering operation.

After the cooling operation, a saturated solution of lithium nitrate $LiNO_3$ in methanol is applied to the sample. That saturated solution is sucked into the pores or cavities by a capillary action. The solvent is evaporated. Application of the solution can be repeated a plurality of times in order to fill the pores with $LiNO_3$ as completely as possible. Metal contacts are now vapor-deposited on the porous silicon sample, with a voltage being applied to the contacts to trigger the reaction between silicon and the oxygen from the $LiNO_3$.

We claim:

1. A nanostructured porous reactive substance formed as a reactive body comprising:

mutually independent reactive particles defining cavities therebetween, said cavities having a range of sizes of 1–100 nm;

barrier layers encasing said particles; and an oxidizing agent disposed in said cavities.

2. A nanostuctured porous reactive substance formed as a reactive body, comprising:

a completely oxidized surface having cavities; and an oxidizing agent disposed in said cavities.

3. The reactive substance according to claim 1, wherein the particle are a first material formed of a fuel, the oxidizing agent is a second material, the barrier layer is a third material, and the third material is chemically, electrochemically, thermally of physically made from a fuel.

4. The reactive substance according to claim 2, which further comprises a barrier layer, in the surface being a first material formed of a fuel, the oxidizing agent being a second material, the barrier layer being a third material, and the third material being chemically, electrochemically, thermally or physically made from a fuel.

5. The reactive substance according to claim 1, wherein the particle are formed of a material selected from the layer consisting of silicon, boron, aluminum, titanium and zirconium.

6. The reactive substance according to claim 2, wherein the surface is formed of a material selected from the group consisting of silicon, boron, aluminum, titanium and zirconium.

7. The reactive substance according to claim 1, wherein the particle are formed of silicon (fuel) having a surface, and the barrier layer is an at least partial sub-oxide covering the surface.

8. The reactive substance according to claim 2, which further comprises an at least partial sub-oxide barrier layer covering the surface, the surface being formed of silicon fuel.

9. The reactive substance according to claim 7, wherein the silicon is a fuel.

10. The reactive substance according to claim 8, wherein the silicon is a fuel.

11. The reactive substance according to claim 5, wherein the particles are formed of individual, mutually independent nanocrystals.

12. The reactive substance according to claim 6, wherein the surface is formed of individual, mutually independent nanocrystals.

13. The reactive substance according to claim 5, wherein the particles are non-crystalline, amorphous or partially crystalline.

14. The reactive substance according to claim 6, wherein the surface is non-crystalline, amorphous or partially crystalline.

15. The reactive substance according to claim 1, wherein the oxidizing agent further comprises the following oxidizers:

alkali metal nitrates: $M^+NO_3^-$, $M^+$=$Li^+$, $Na^+$, $K^+$, $Rb^+$, $Cs^+$ alkaline earth metal nitrates: $M^{2+}(NO_3^-)_2$, $M^{2+}$=Ca, $Sr^{2+}$, $Ba^{2+}$ perchlorates of alkali metals and: $M^+ClO_4^-$, alkaline earth metals: $M^{2+}(ClO_4^-)_2$, nitrates and perchlorates of rare earth metals ammonium perchlorate: $NH_4ClO_4$ ammonium nitrate: $NH_4NO_3$ peroxides: $H_2O_2$ (stabilized, fluid)

fluid oxidizers: NH—$NH_2$, $NH_2$—$NH_3^+NO_3^-$, $NH_2$—OH.

16. The reactive substance according to claim 2, wherein the oxidizing agent further comprises the following oxidizers:

alkali metal nitrates: $M^+NO_3^-$, $M^+$=$Li^+$, $Na^+$, $K^+$, $Rb^+$, $Cs^+$ alkaline earth metal nitrates: $M^{2+}(NO_3^-)_2$, $M^{2+}$=Ca, $Sr^{2+}$, $Ba^{2+}$ perchlorates of alkali metals and: $M^+ClO_4^-$, alkaline earth metals: $M^{2+}(ClO_4^-)_2$, nitrates and perchlorates of rare earth metals ammonium perchlorate: $NH_4ClO_4$ ammonium nitrate: $NH_4NO_3$ peroxides: $H_2O_2$ (stabilized, fluid)

fluid oxidizers: NH—$NH_2$, $NH_2$—$NH_3^+NO_3^-$, $NH_2$—OH.

17. The reactive substance according to claim 1, wherein said barrier layers are safely triggerable between −40° C. and +100° C.

18. The reactive substance according to claim 2, wherein said completely oxidized surface ate safely triggerable between +40° C. and +100° C.

* * * * *